US006646230B2

(12) United States Patent
Girlando et al.

(10) Patent No.: US 6,646,230 B2
(45) Date of Patent: Nov. 11, 2003

(54) GLOW PLUG ARRANGED FOR MEASURING THE IONIZATION CURRENT OF AN ENGINE, AND METHOD FOR MANUFACTURING THE SAME

(75) Inventors: Simone Girlando, Cognento (IT); Stefano Vignoli, Gargallo di Carpi (IT); Sandro Goretti, Campogalliano (IT)

(73) Assignee: Federal-Mogul Ignition Srl, Milan (IT)

( * ) Notice: Subject to any disclaimer, the term of this patent is extended or adjusted under 35 U.S.C. 154(b) by 0 days.

(21) Appl. No.: 10/094,492

(22) Filed: Mar. 8, 2002

(65) Prior Publication Data

US 2002/0130120 A1 Sep. 19, 2002

(30) Foreign Application Priority Data

Mar. 14, 2001 (EP) ..... 01830170

(51) Int. Cl.[7] ..... F23Q 7/00
(52) U.S. Cl. ..... 219/270; 123/145 A; 313/141
(58) Field of Search ..... 219/270, 544; 361/264, 265, 266; 123/145 A, 145 R, 143 C; 313/118, 141, 142, 143

(56) References Cited

U.S. PATENT DOCUMENTS 4,351,291 A * 9/1982 Mahaney ..... 123/145 A
4,476,378 A * 10/1984 Takizawa et al. ..... 219/270
4,549,071 A * 10/1985 Hatanaka et al. ..... 219/270
4,901,196 A * 2/1990 Grzybowski ..... 361/266
5,039,839 A * 8/1991 Masaka et al. ..... 219/270
5,118,921 A * 6/1992 Aota ..... 219/270
6,037,568 A * 3/2000 Hatanaka et al. ..... 219/270
6,062,185 A * 5/2000 Chiu et al. ..... 123/145 A
6,177,653 B1 1/2001 Chiu et al.
6,215,105 B1 4/2001 Simpkins et al.
6,512,204 B1 * 1/2003 Chiu et al. ..... 219/270

FOREIGN PATENT DOCUMENTS

EP 0989370 A 3/2000
EP 1050717 A 11/2000

* cited by examiner

*Primary Examiner*—Sang Y. Paik
*Assistant Examiner*—Fadi H. Dahbour
(74) *Attorney, Agent, or Firm*—Reising, Ethington, Barnes, Kisselle, P.C.

(57) ABSTRACT

A glow plug (10) that includes a metal tubular body (12), a metal sheath (24) carried by the tubular body, a heating resistor (33) located inside the sheath, first and second electrical terminals (30,32), and a layer (36) of insulating material applied on a portion of the outer surface of the sheath. The first terminal (30) is electrically connected to the heating resistor (33) and the second terminal (32) is electrically connected to the sheath (24). The layer (36) of insulating material is located on the sheath (24) between the sheath and tubular body (12) to thereby electrically insulate the metal sheath from the metal tubular body. The layer (36) of insulating material can be applied by plasma deposition which enables the sheath (24) to be attached to the tubular body (12) by an interference fit of the sheath within a cavity (16) in the tubular portion. Also disclosed is a method of fabricating the glow plug (10).

11 Claims, 1 Drawing Sheet

GLOW PLUG ARRANGED FOR MEASURING THE IONIZATION CURRENT OF AN ENGINE, AND METHOD FOR MANUFACTURING THE SAME

TECHNICAL FIELD

The present invention relates generally to glow plugs for diesel engines and, in particular, to glow plugs capable of measuring the ionization current inside the engine combustion chamber. The invention also relates to methods for manufacturing such glow plugs.

BACKGROUND OF THE INVENTION

European published patent application number EP-A-0989370 describes a glow plug provided with a tubular metal body and with a metal sheath electrically insulated from the tubular body. An electrical heating element is housed inside the sheath and is connected to a first electrical terminal. The sheath is made of metal material and is insulated from the tubular body by means of a pair of rings of ceramic material set at the opposite ends of the tubular body. The sheath is electrically connected to a second terminal consisting of a wire provided with insulating coating which is welded to the end edge of the sheath and is set inside the tubular body.

The known solution described in the document EP-A-0989370 presents a number of drawbacks due to the high number of components necessary for ensuring electrical insulation and gas tightness between the sheath and the insulating body. The fact that the solution according to the prior art envisages the use of ceramic rings for insulating the sheath from the tubular body can entail considerable difficulties and high costs in order to achieve the necessary gas tightness on the contact surface between the ceramic rings and the sheath. In addition, the dimensions of the ceramic rings render the application of this solution to plugs with small diameters, for example 4 mm or 5 mm, difficult. A further disadvantage of the known solution lies in the difficulty in obtaining the necessary tolerances of coaxiality and roundness between the sheath and the tubular body.

A general object of the present invention is to provide a glow plug of the type indicated above that makes it possible to overcome the drawbacks referred to previously.

SUMMARY OF THE INVENTION

According to one aspect of the present invention, there is provided a glow plug that includes a metal tubular body, a metal sheath carried by the tubular body, a heating resistor located inside the sheath, first and second electrical terminals, and a layer of insulating material applied on a portion of the outer surface of the sheath. The first terminal is electrically connected to the heating resistor and the second terminal is electrically connected to the sheath. The layer of insulating material is located on the sheath between the sheath and tubular body to thereby electrically insulate the metal sheath from the metal tubular body. Preferably, the insulating material is applied by plasma deposition with the sheath being attached to the tubular body by an interference fit of the sheath within a cavity in the tubular portion.

In accordance with another aspect of the invention, there is provided a method of fabricating a glow plug as described above in which the sheath and its terminals and heating resistor together comprise a heating element carried by the tubular body. The method includes the steps of depositing a layer of insulating material on a portion of the outer surface of the sheath and fixing the heating element to the metal tubular body with the layer of insulating material disposed between the heating element and tubular body. Again, the insulating layer is preferably applied by plasma deposition and the sheath can be attached to the tubular body by forming an interference fit between the heating element and tubular body.

BRIEF DESCRIPTION OF THE DRAWINGS

The present invention will now be described in detail with reference to the attached drawings, in which.

DETAILED DESCRIPTION OF THE PREFERRED EMBODIMENTS

Figure 1:
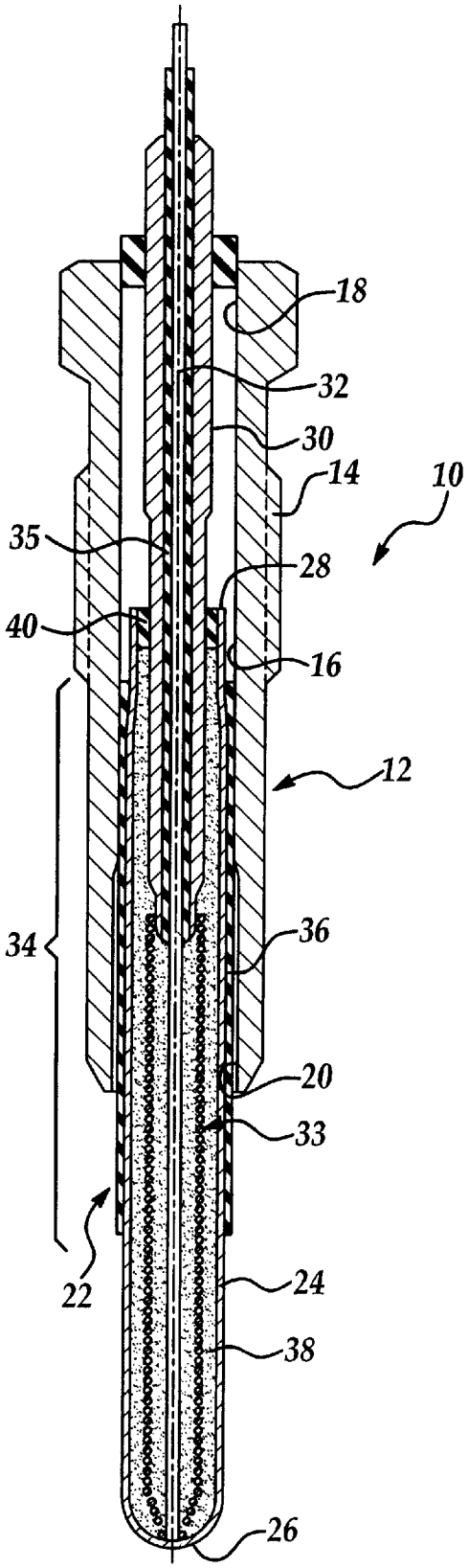
FIG. 1 is a longitudinal section of a glow plug according to a first embodiment of the present invention.
Figure 2:
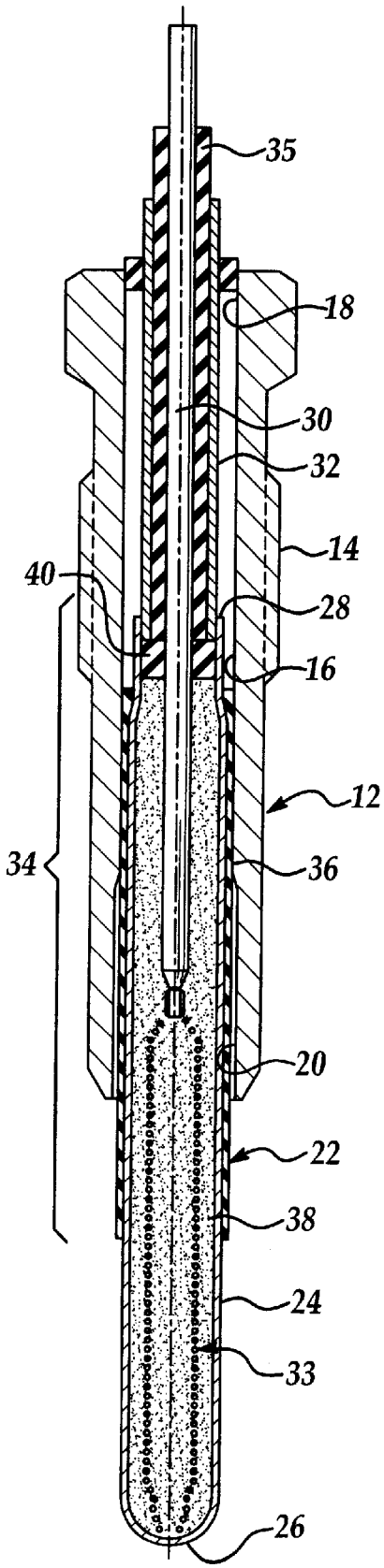
FIG. 2 is a longitudinal section illustrating a variant of the glow plug according to the invention.

With reference to FIGS. 1 and 2, the number 10 designates a glow plug for diesel engines. The glow plug 10 comprises a metal tubular body 12 having a threaded portion 14 designed to engage a threaded hole (not illustrated) provided in the cylinder head of a diesel engine. The tubular body 12 has a through cavity 16, which has a first end 18 and a second end 20.

The plug 10 comprises a heating element 22 electrically insulated from the metal tubular body 12 in the way that will be described in what follows. With reference to FIG. 2, the heating element 22 comprises a metal sheath 24 made of a material with high characteristics of resistance to temperature and corrosion, for example Inconel. The sheath 24 has a first end 26, which is closed and has a rounded shape, and a second end 28, which is open and through which there extend two coaxial electrical terminals 30, 32 made in the way described in our commonly-owned, co-pending U.S. Application No. 10/092,713 filed Mar. 7, 2002, the complete disclosure of which is hereby incorporated by reference. As described in detail in that patent application, contained inside the sheath 24 is an electric heating resistor 33 consisting of one or two coils made of conductive wire. The heating resistor 33 is electrically connected to the first terminal 30 and to the end 26 of the sheath 24, whilst the second electrical terminal 32 is insulated from the first electrical terminal 30 and is electrically connected to the sheath 24.

In the embodiment of FIG. 1, the second terminal 32 is a wire that extends inside the first terminal 30. The second terminal 32 extends inside the coiled heating resistor 33 and is connected to the sheath 24 by means of the same weld that connects the end of the resistor 33 to the sheath 24.

In the variant of FIG. 2, the second terminal 32 is a metal tube set outside of the first terminal 30 and in contact with the end edge 28 of the sheath 24. In both embodiments, a tube made of insulating material 35 is provided, which insulates the terminals 30 and 32 from one another.

In use, the glow plug may be used as a heating glow plug during the engine cold-starting phase or else as a sensor of the ionization current inside the combustion chamber during normal engine operation. The function of the glow plug as a heating plug is obtained by connecting the second terminal 32 to ground and the first terminal 30 to the positive pole of the battery, or vice versa. Operation as ionization-current sensor is obtained by leaving the first terminal 30 open and by connecting the second terminal 32 to a pre-set reference potential.

The present invention specifically relates to the way in which the electrical insulation between the heating element 22 and the tubular body 12 is obtained. According to the invention, a portion 34 of the outer surface of the sheath 24 is coated with a layer of insulating material, designated by 36. The layer 36 of insulating material is deposited on the surface of the finished heating element 22.

The heating element 22 is produced by inserting, inside the sheath 24, the coiled resistor 33 which has been previously fixed to the metal bar made up of the coaxial electrodes 30, 32. One end of the coiled heating resistor 33 is welded in a known way to the end 26 of the sheath 24. The sheath 24 is then filled with a powder 38 of insulating material, and an insulating ring 40 is set between the end 28 of the sheath 24 and the electrodes 30, 32. The sheath 24 subsequently undergoes a hammering operation to close the sheath around the insulating ring 40 by plastic deformation at its open end 28 using radial compression of the sheath.

After the finished heating element 22 has been obtained through the sequence of operations described above, the portion 34 of the outer surface of the sheath undergoes an operation of deposition of a layer of insulating material. Deposition of the insulating layer may be performed using different techniques. In general, any deposition technique makes it possible to obtain a relatively small thickness of insulating material. A particularly advantageous technique consists in plasma deposition, which enables deposition of layers having a thickness of between a few micron and a few hundred micron, with relatively short working times. An important characteristic of the plasma-deposition technique lies in that fact that very high values of mechanical anchorage of the layer deposited to the substrate are achieved. It is necessary for the insulating material deposited to maintain its physical characteristics of electrical insulator even at high temperatures because the plug is designed to operate in a particularly hot environment. Equally important is the choice of the insulating material, in so far as it must possess considerable characteristics of hardness and mechanical resistance in order to withstand the mechanical stresses that occur during assembly of the heating element 22 with the tubular shell 12. In addition, the layer 36 of insulating material must guarantee sufficient heat exchange between the heating element 22 and the tubular body 12; consequently, the insulating material deposited must possess a high coefficient of thermal conductivity. An example of material that possesses the aforesaid characteristics and that can be deposited using a plasma-deposition technique is aluminium oxide $Al_2O_3$.

A particularly advantageous characteristic of the present invention lies in the fact that the finished heating element 22 provided with the layer 36 of insulating material is fixed to the tubular body 12 using the same technology as that envisaged for traditional (non-bipolar) glow plugs, in which the sheath 24 is without the insulating coating layer 36. In particular, it is envisaged that the heating element 22 should be driven with radial interference inside the cavity 16 of the tubular body 12.

The technique of so-called "cold"aluminium-oxide plasma deposition (i.e., in which the sheath is kept at a temperature of approximately 100° C.) guarantees anchorage values of the insulating layer 36 to the substrate that are considerably high (typically in the region of 30–40 $N/mm^2$). It is very important that the insulating layer should behave mechanically as an integral part of the heating element 22, namely, that the value of anchorage between the layer deposited and the substrate should be sufficiently high to withstand the mechanical stresses induced by driving the heating element 22 into the tubular body 12, without any (albeit partial) detachment of the insulating layer 36. The plasma-deposition technique makes it possible to obtain an insulating layer that withstands, without damage, stresses resulting from driving loads of between 150 and 800 daN upon fitting between the heating element 22 and the hollow body 12. Tests carried out by the present applicant have shown that the layer 36 of insulating material does not alter the temperature curves that are characteristic of the heating element 22.

The thickness of the insulating layer 36 must be controlled in such a way as to obtain a pre-set interference with the diameter of the cavity 16 of the tubular body 12. Possibly, after the operation of deposition of the insulating layer 36, the heating element 22 may undergo a grinding operation to achieve pre-set tolerances in terms of roundness and cylindricity necessary for ensuring proper fit with the tubular body 12.

What is claimed is:

1. A glow plug for diesel engines, comprising:

a metal tubular body;

a metal sheath carried by the tubular body;

a heating resistor located inside the sheath and electrically connected at one end to the sheath;

a first electrical terminal connected to another end of the heating resistor;

a second electrical terminal electrically connected to the sheath; and a layer of insulating material applied on a portion of the outer surface of the sheath;

the sheath being retained in the tubular body by an interference fit such that the layer of insulating material is in direct contact with both the sheath and tubular body to thereby electrically insulate the metal sheath from the metal tubular body.

2. A glow plug according to claim 1, characterized in that the layer of insulating material is applied by means of plasma deposition.

3. A glow plug according to claim 1, characterized in that the layer of insulating material is aluminium oxide.

4. A glow plug according to claim 1, characterized in that the layer of insulating material has a thickness that is controlled by a grinding operation to establish a pre-set interference condition within the tubular body.

5. A glow plug according to claim 1, characterized in that the tubular body is provided with means for fixing the tubular body to the cylinder head of an engine.

6. A glow plug according to claim 5, characterized in that the means for fixing the tubular body to the cylinder head of an engine comprises a threaded portion of the tubular body.

7. A method of fabricating a glow plug for diesel engines, comprising the steps of:

providing a metal tubular body;

providing a heating element including a metal sheath, a heating resistor electrically connected at one end to the sheath and being contained inside the metal sheath, a first terminal electrically connected to another end of the resistor, and a second terminal electrically connected to the sheath; and depositing a layer of insulating material on a portion of the outer surface of the sheath; and forming an interference fit between the heating element and tubular body by driving the heating element into the tubular body, such that the layer of insulating material is in direct contact with the metal sheath and metal tubular body to thereby electrically insulate the metal sheath from the metal tubular body.

8. The method according to claim 7, characterized in that the depositing step further comprises applying the layer of insulating material by plasma deposition.

9. The method according to claim 7, characterized in that the layer of insulating material is aluminium oxide.

10. A method of fabricating a glow plug for diesel engines, comprising the steps of:

providing a metal tubular body;

providing a heating element including a metal sheath, a heating resistor electrically connected at one end to the sheath and being contained inside the metal sheath, a first terminal electrically connected to another end of the resistor, and a second terminal electrically connected to the sheath; and depositing a layer of insulating material on a portion of the outer surface of the sheath; and fixing the heating element to the metal tubular body with the layer of insulating material disposed between the heating element and tubular body;

wherein the step of providing the heating element further comprises deforming the sheath at an open end of the sheath by radial compression of the sheath, and wherein the depositing step further comprises applying the insulating material to the sheath after the deforming step.

11. The method according to claim 7, further comprising the step of grinding the heating element after deposition of the insulating material to obtain a pre-set interference condition between the heating element and the metal tubular body.

* * * * *